US009873030B2

(12) United States Patent
Frostino

(10) Patent No.: US 9,873,030 B2
(45) Date of Patent: Jan. 23, 2018

(54) ADJUSTABLE BASKETBALL TRAINING APPARATUS

(71) Applicant: Frank Frostino, Westlake, OH (US)

(72) Inventor: Frank Frostino, Westlake, OH (US)

( * ) Notice: Subject to any disclaimer, the term of this patent is extended or adjusted under 35 U.S.C. 154(b) by 263 days.

(21) Appl. No.: 14/155,576

(22) Filed: Jan. 15, 2014

(65) Prior Publication Data

US 2014/0200102 A1 Jul. 17, 2014

Related U.S. Application Data

(60) Provisional application No. 61/752,737, filed on Jan. 15, 2013.

(51) Int. Cl.

| | |
|---|---|
| ***A63B 69/00*** | (2006.01) |
| *A63B 63/08* | (2006.01) |
| *A63B 47/00* | (2006.01) |
| *A63B 71/02* | (2006.01) |

(52) U.S. Cl.

CPC ..... *A63B 69/0071* (2013.01); *A63B 47/00* (2013.01); *A63B 63/083* (2013.01); *A63B 69/0002* (2013.01); *A63B 2071/025* (2013.01); *A63B 2071/026* (2013.01); *A63B 2208/12* (2013.01); *A63B 2210/50* (2013.01); *A63B 2225/093* (2013.01)

(58) Field of Classification Search

CPC ..... A63B 63/08; A63B 69/36; A63B 67/02; A63B 63/083; A63B 69/0071; A63B 69/0057; A63B 71/022

USPC ..... 473/422, 446, 447, 448, 433

See application file for complete search history.

(56) References Cited

U.S. PATENT DOCUMENTS

| | | | | | |
|---|---|---|---|---|---|
| 4,565,527 | A * | 1/1986 | Burchett | | 473/446 |
| 5,160,138 | A * | 11/1992 | Sanders | | 473/438 |
| 5,485,993 | A * | 1/1996 | Lipsett | | 473/448 |
| 5,527,185 | A * | 6/1996 | Davis | | 473/438 |
| 5,599,016 | A * | 2/1997 | Larkin | | 473/448 |
| 5,800,291 | A * | 9/1998 | Grover | | 473/447 |
| 5,813,926 | A * | 9/1998 | Vance | | 473/448 |
| 6,159,111 | A * | 12/2000 | Purcell | | 473/422 |
| 6,213,899 | B1 * | 4/2001 | Maske | | 473/409 |
| 6,312,349 | B1 * | 11/2001 | Roberts | | 473/448 |
| 6,343,998 | B1 * | 2/2002 | Tarulli et al. | | 473/273 |
| 6,544,132 | B1 * | 4/2003 | Tvedt | | 473/448 |
| 6,679,794 | B1 * | 1/2004 | Vitello et al. | | 473/433 |
| 7,175,549 | B2 * | 2/2007 | LeFlore | | 473/448 |
| 7,393,290 | B2 * | 7/2008 | Martin | A63B 47/002 | 473/422 |
| 7,658,689 | B2 * | 2/2010 | Crook, II | | 473/447 |
| 8,277,340 | B1 * | 10/2012 | Devine | | 473/447 |

(Continued)

*Primary Examiner* — Mitra Aryanpour

(74) *Attorney, Agent, or Firm* — McDonald Hopkins LLC

(57) ABSTRACT

An adjustable basketball training apparatus comprising an upper portion having a horizontal obstruction supported by one or more support members and a lower portion movably attached to said support members such that the height of the horizontal obstruction may be adjusted to force a player to release a basketball with a desirable trajectory toward the intended target, such as a basket or another player, and methods for use thereof. The training apparatus is adjustable and may include vertical obstructions extending from the horizontal obstruction, attachments that simulate all or part of a defender, means for distracting a player, and a ball storage rack.

6 Claims, 6 Drawing Sheets

(56) References Cited

U.S. PATENT DOCUMENTS

| | | | | |
|---|---|---|---|---|
| 8,647,220 | B2 * | 2/2014 | Lloyd | 473/422 |
| 8,721,476 | B2 * | 5/2014 | Mayers | 473/447 |
| 8,900,074 | B1 * | 12/2014 | Johnson | A63B 69/205 473/422 |
| 2004/0157685 | A1 * | 8/2004 | Hodges | 473/448 |
| 2005/0192126 | A1 * | 9/2005 | Remaklus | 473/447 |
| 2007/0010354 | A1 * | 1/2007 | White | 473/447 |
| 2010/0160093 | A1 * | 6/2010 | MacArthur | 473/447 |
| 2014/0171229 | A1 * | 6/2014 | Klunick | 473/447 |
| 2014/0200102 | A1 * | 7/2014 | Frostino | 473/447 |

* cited by examiner

ADJUSTABLE BASKETBALL TRAINING APPARATUS

CROSS-REFERENCE TO RELATED APPLICATION

This application claims priority to U.S. provisional application no. 61/752,737, filed Jan. 15, 2013, which is herein incorporated by reference in its entirety.

FIELD

The present technology provides for an adjustable apparatus for enhancing a basketball player's skills and method of using same.

BACKGROUND

To increase proficiency at the sport of basketball, players must spend significant time practicing various skills. One of the most important skills is shooting, which requires releasing the ball with an appropriate arc and follow-through in the proper direction. Other important skills include different types of passing and ball handling techniques. Each of these skills requires concentration, eye-hand coordination, and proper form and technique, all of which can be improved through repetition and practice.

Often, it is desirable for a basketball player to practice with other players, coaches or persons who can provide guidance and facilitate various practice scenarios. For example, a coach can provide guidance and feedback to a shooter regarding the arc and follow-through for various types of shots, such as free throws, jump shots and low post shots. Likewise, a coach or other person can help a player practice various passing and ball-handling techniques in various ways, for example, by simulating a defender or an obstruction that the practicing player must avoid.

In many instances, however, there may not be a sufficient number of other players, coaches or other persons available to provide the desired guidance or to facilitate the desired practice scenarios. Existing solutions have been devised, but none provide all of the advantages of the invention disclosed herein. For example, cones or similar objects can be placed at various locations to indicate the location of defenders, and objects such as chairs and ladders can be used as larger obstacles to shoot over or pass around. These objects, however, often are inadequate to simulate many desirable practice conditions and scenarios and do not provide the player with guidance or feedback regarding technique. A need therefore exists for a basketball training apparatus that can be used more independently by a practicing player as shown and described herein.

SUMMARY OF THE INVENTION

An adjustable basketball training apparatus and method are shown and described. The training apparatus may include an adjustable horizontal obstruction over which a player must launch or release the ball, thus forcing a more desirous path between the player and the target. The training apparatus also may include vertical obstructions that may be removable or adjustable that can help align a shot and force a more desirous path between the shooter and the basket (hoop) and optionally a storage compartment for storing the vertical obstructions for when they are not in use. The training apparatus further may be configured to have dimensions suitable for practicing various types of passing and ball-handling skills.

Additionally, the training apparatus may include one or more ball storage racks that allow for storage of one or more basketballs. The training apparatus also may include one or more adjustable attachments that can simulate additional desirable practice conditions, including features resembling the hands, arms, head or body of a defender, or other features such as lights, noise or other potential distractions. The training apparatus further may include a laser guide alignment system that can help align the player to the target. The training apparatus also may be configured to disassemble for enhanced portability and storage efficiency.

The training method may include use of a training apparatus that includes an adjustable horizontal obstruction over which a player must launch or release the ball, thus forcing a more desirous path between the shooter and the intended target. The training method also may include use of a training apparatus that includes vertical obstructions that may be removable or adjustable that can help align a shot and force a more desirous path between the player and the basket and optionally a storage compartment for storing the vertical obstructions for when they are not in use. The training method further may include use of a training apparatus that may be configured to have dimensions suitable for practicing various types of passing and ball-handling skills.

Additionally, the training method may include use of a training apparatus that includes one or more ball storage racks that allow for storage of a one or more basketballs. The training method also may include use of a training apparatus that includes one or more adjustable attachments that can simulate additional desirable practice conditions, including features resembling the hands, arms, head or body of a defender, or other features such as lights, noise or other potential distractions. The training method also may include use of a laser guide alignment system that can help align the player to the target. The training method also may include use of a training apparatus that may be configured to disassemble for enhanced portability and storage efficiency.

BRIEF DESCRIPTION OF THE DRAWINGS AND ATTACHMENTS

Figure 6A:
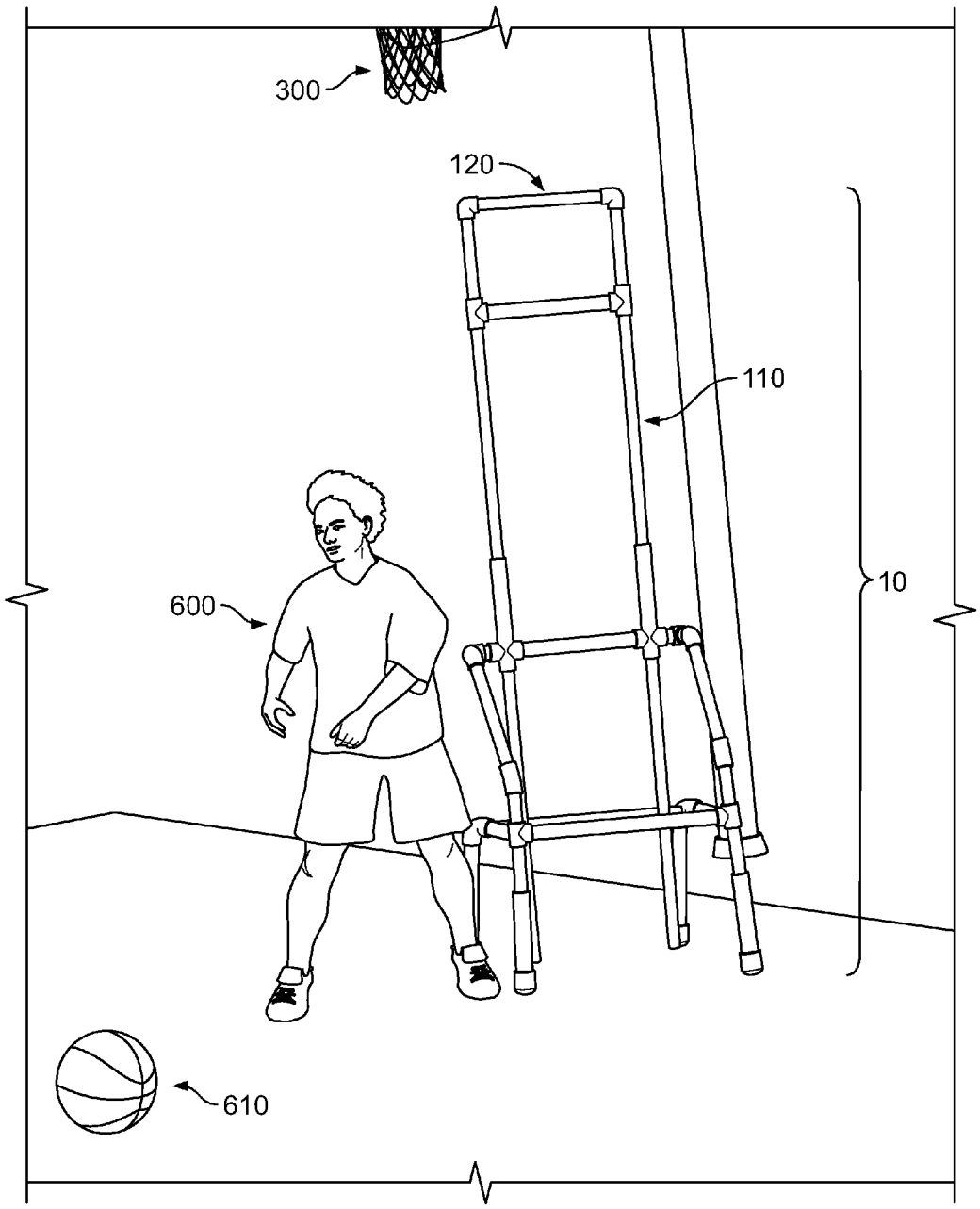
Figure 6B:
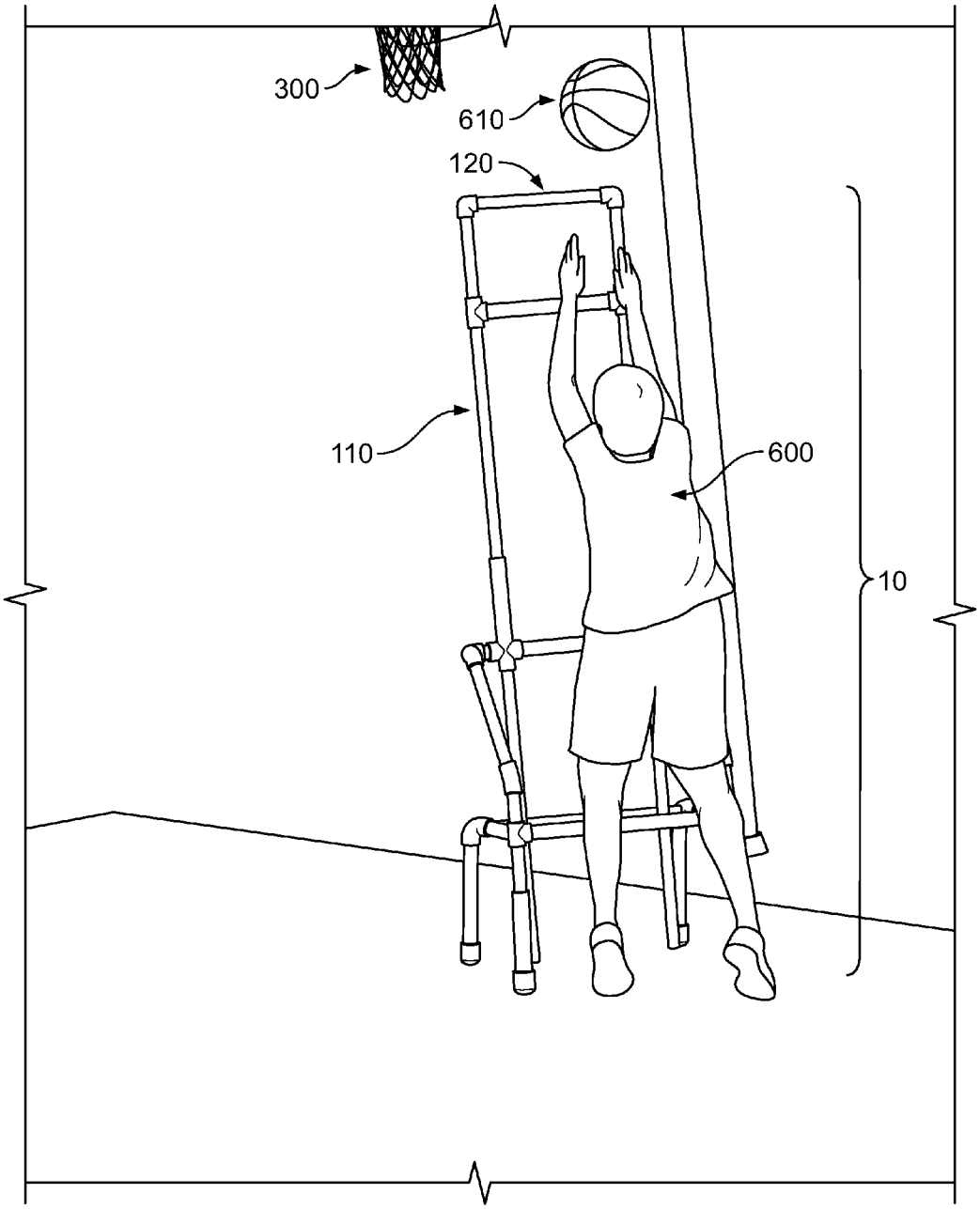

FIGS. 6*a* and 6*b* show an embodiment of a method for using an adjustable basketball training apparatus.

DETAILED DESCRIPTION

Reference will now be made in detail to exemplary embodiments of the present invention, examples of which are illustrated in the accompanying figures. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

Training apparatus 10 as shown in FIGS. 1 through 6 generally may be regarded has having an upper portion 100 that includes one or more adjustable support members 110 that support horizontal obstruction 120 and, optionally, vertical obstructions 120, and a lower portion 200 to which adjustable support members 110 attach and may include a base 210, a ball rack 220, and a storage compartment 230. It should be understood that, while training apparatus 10 can be understood as being comprised of upper portion 100 and lower portion 200, separate identification of such portions is for convenience only and is not intended to limit the scope of the invention.

Figure 1:
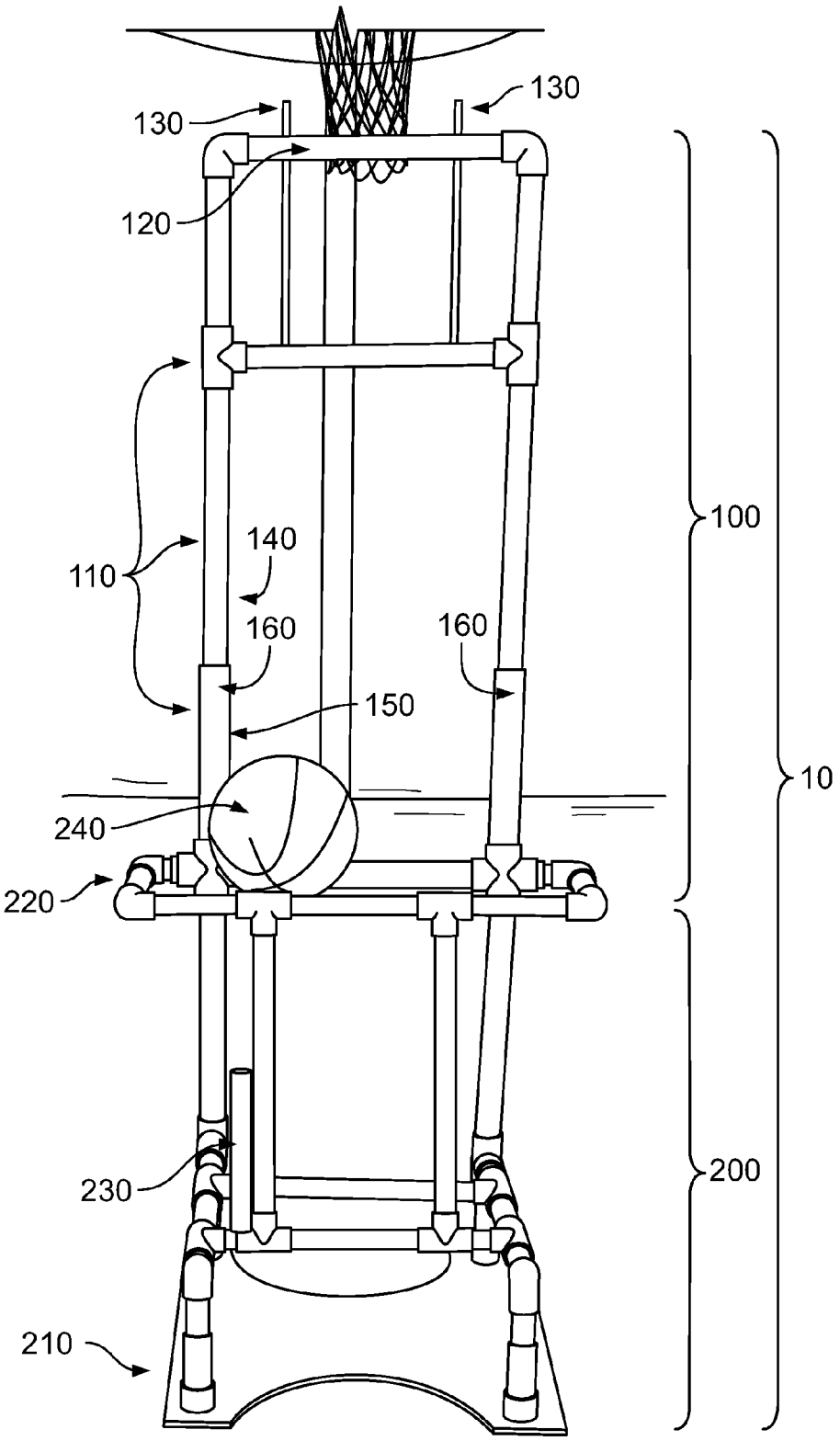
FIG. 1 is a view of an embodiment of an adjustable basketball training apparatus.
Figure 2:
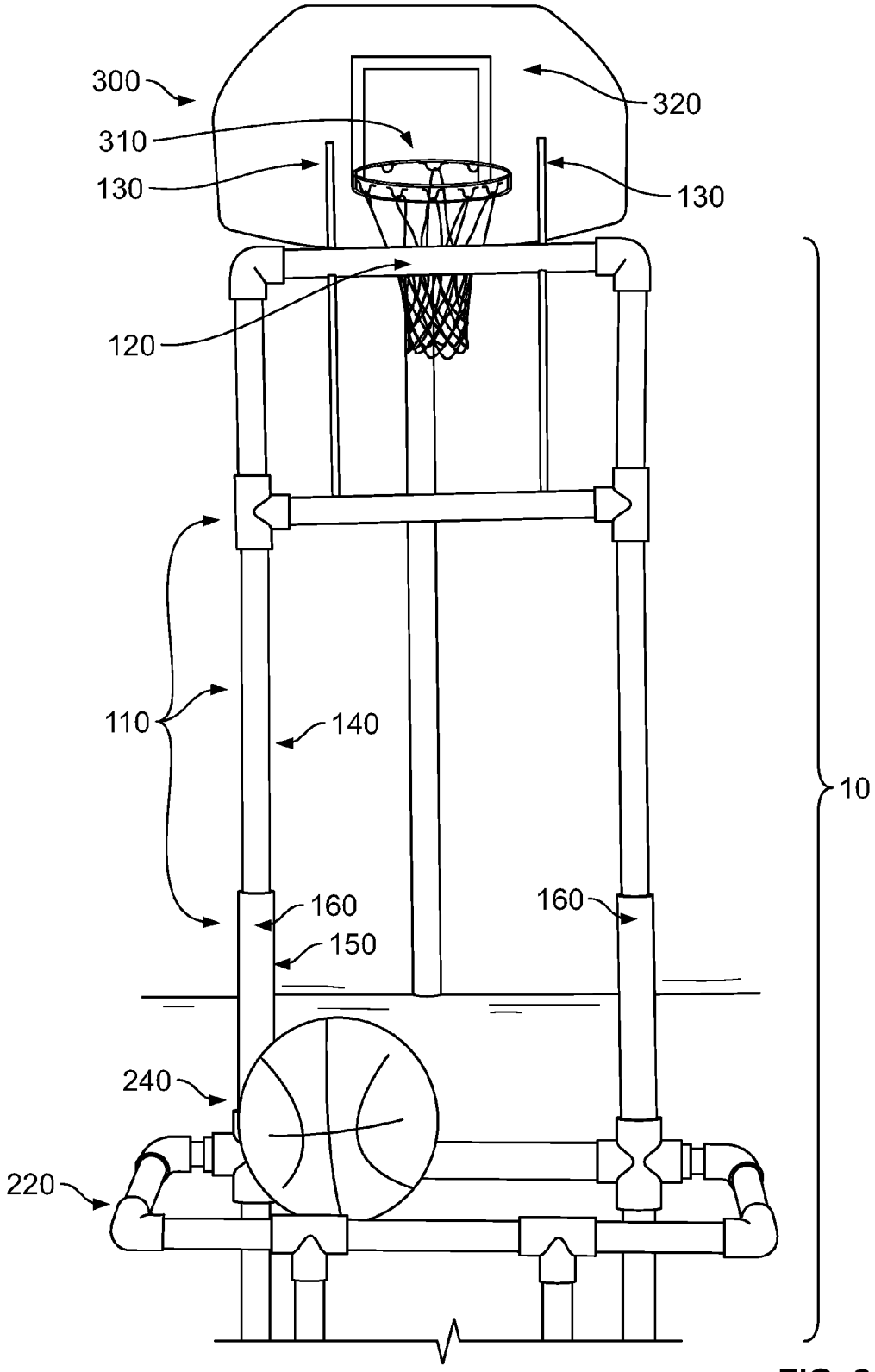
FIG. 2 is an alternate view of an embodiment of an adjustable basketball training apparatus.

As shown in FIGS. 1 and 2, training apparatus 10 may include an adjustable horizontal obstruction 120 over which the shooter must launch the ball to achieve a more desirous path between the shooter and the basket. Horizontal obstruction 120 may be configured in any number of regular and irregular shapes and sizes. For example, horizontal obstruction 120 can be configured to resemble the head or other body party of a defender or a screen that at least partially blocks the shooter's view of the basket area. Irrespective of the configuration of horizontal obstruction 120, when properly configured, it can help eliminate "flat" shots by forcing the shooter to shoot the ball along a more desirous path between the shooter and the basket with a desirable arc.

Horizontal obstruction 120 is supported by one or more support members 110 that can be adjusted to raise or lower horizontal obstruction 120 to accommodate different heights and desired uses. The height of horizontal obstruction 120 thus can be determined by the user. FIG. 1 shows the height of horizontal obstruction 120 positioned relatively low with respect to the height of the basket, and FIG. 2 shows the height of horizontal obstruction 120 positioned relatively higher with respect to the height of basket 310.

In one embodiment, support member 110 comprises a sliding frame 140 that is movably attachable to receiving member 150 at varying positions to permit adjustment of the height of horizontal obstruction 120, as shown in FIGS. 1 and 2. The height of horizontal member 120 preferably can be adjusted between 5 feet and 9 feet high, although there is no limitation as to the height of horizontal obstruction 120. Sliding frame 140 that supports horizontal obstruction 120 is secured to receiving member 150 at the desired height using retainer 160, which may be a removable pin, screw or other retainer.

Figure 4:
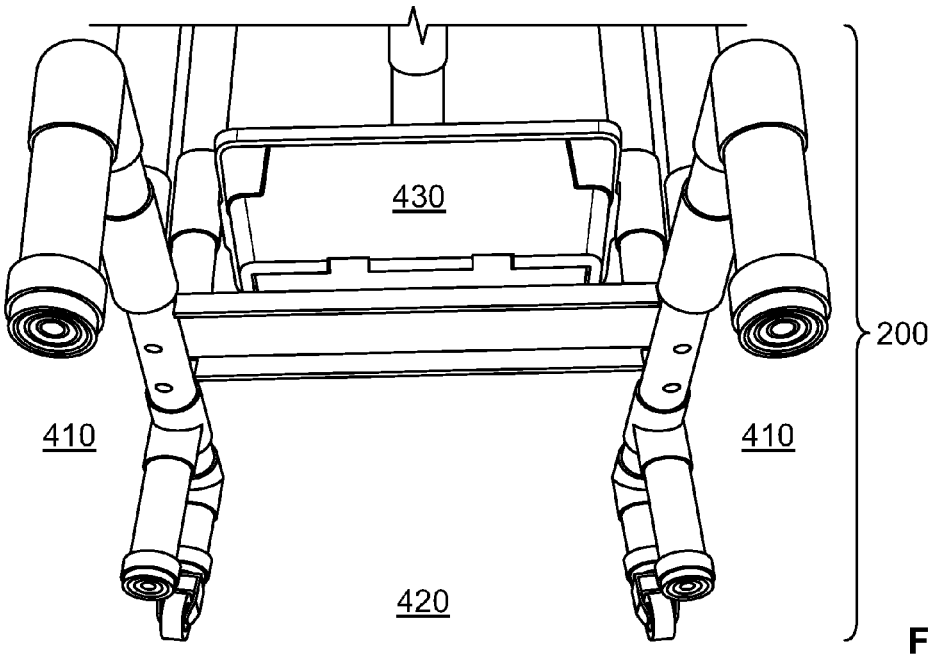
FIG. 4 is a view of an embodiment of the lower portion of an adjustable basketball training apparatus.

Training apparatus 10 can include one or more vertical obstructions 130 that may be useful for helping a shooter establish a proper arm angle and alignment for the launch and release point and forcing a more desirous path between the shooter and the basket. Vertical obstructions 130 may be removably attached and may be configured in any number of regular and irregular shapes and sizes. In one embodiment, vertical obstruction 130 is removably attachable to horizontal obstruction 120. In other embodiments, vertical obstructions 130 may be attached to other parts of upper portion 100. Training apparatus 10 also may include a storage compartment 230 to hold vertical obstructions 130 when they are not in use, as shown in FIG. 4.

As shown in FIG. 2, vertical obstructions 130 can be aligned with the basket 310 or the markings on backboard 320 of the basket assembly 300 to help a free throw shooter to line up a shot with basket 310 and accurately launch a shot. Vertical obstructions 130 may be fully adjustable, for example, with respect to height, width, direction and angle, to simulate different shooting conditions and scenarios. Vertical obstructions 130 also can be configured to simulate a leaping defender or to block certain shot angles.

Figure 3:
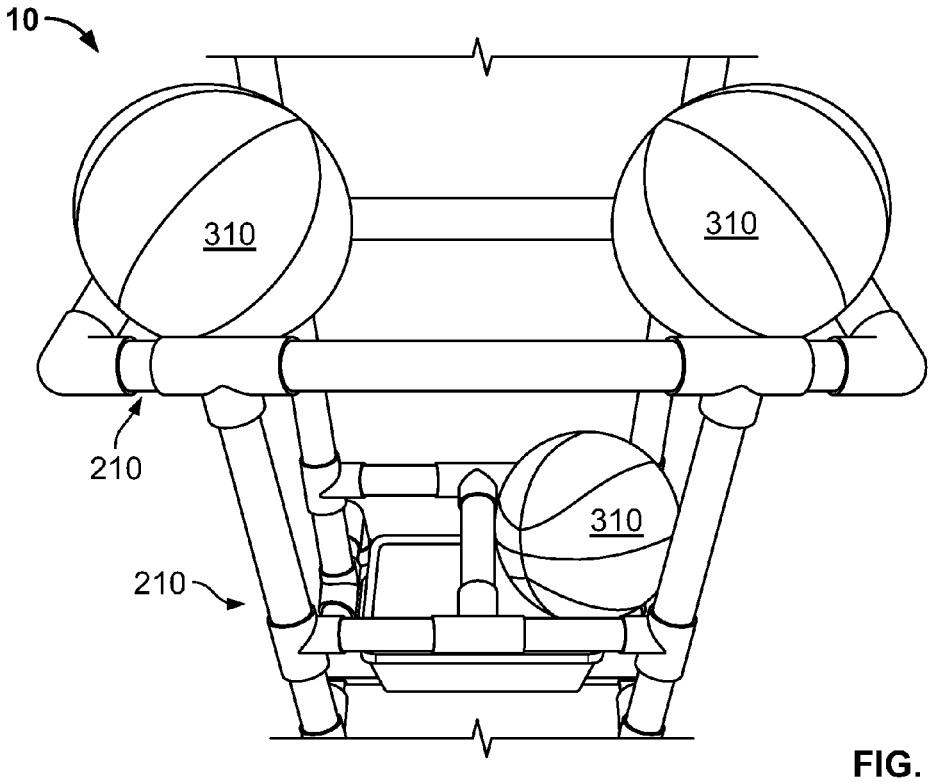
FIG. 3 is a view of an embodiment of an adjustable basketball training apparatus having two ball storage racks.

Training apparatus 10 may include a ball storage rack 220 that allows for storage of one or more basketballs 240. Preferably, ball storage rack 220 is configured to face the shooter to permit easy access to stored balls 240 for use in repetitive shooting drills. Ball storage rack 220 may be adjustable in multiple ways. For example, in one embodiment, the height of ball storage rack 220 may be adjustable to accommodate convenient use different height shooters. In another embodiment, the angle of ball storage rack 220 may be adjustable such that the stored balls 240 roll to one side or the other as balls are removed from the rack. FIG. 3 shows an embodiment of training apparatus 10 having two ball storage racks 220 capable of storing up to five balls, with three balls 310 shown in said racks.

In addition to the horizontal and vertical obstructions, the dimensions of training apparatus 10 can be useful for simulating certain desirable simulations, and may be selectively adjustable by the user. For example, training apparatus 10 may include one or more adjustable attachments that can provide additional width, and may include attachments resembling the hands, arms, head or body of a defender. Other attachments may include lighting, noise or other potential distractions. Such attachments can be integral with or removably attached to horizontal obstruction 120, vertical obstruction 130, or any other element of training apparatus 10, or may be in addition to or in lieu of horizontal obstruction 120 and vertical obstruction 130, and may be configured to include advertising, personalization or other information or content. The training apparatus 10 also may include a laser guide alignment system to help align the player, the apparatus, or both with the basket or other target.

Lower portion 200 preferably is constructed of sufficiently rigid and stable material for use on inside and outside surfaces. Lower portion 200 should be sufficiently configured and weighted (using fixed or removable weights, which could include sand, water, metal or other suitable materials) so that training apparatus 10 remains stable during ordinary use. FIG. 4 shows an embodiment having container 430 attached to lower portion 200 for holding such weights. For inside use, the base 210 can be equipped with felt or other non-abrasive or scuff-proof surfaces or pads that that can be permanently or removably affixed to the bottom of the lower portion to prevent scratching a gym floor. When used outside or on uneven surfaces, all or part of lower portion 200, including base 210, can be removed. Uneven surfaces may be accommodated through the use of adjustable feet or other surfaces that can be permanently or removably affixed to lower portion 200. Lower portion 200 also may be equipped with wheels, non-skid pads, or other attachments to facilitate or prevent movement of the apparatus before, during and after use on various surfaces and in various conditions. FIG. 4 shows the bottom area of an embodiment where lower portion 200 has been equipped with both non-scuff, non-abrasive pads 410 and wheels 420.

Training apparatus 10 may be constructed out of any suitable material or materials, including but not limited to PVC pipe, aluminum pipe, galvanized pipe, conduit, steel pipe, plastic, wood, fiberglass or other appropriate materials or a combination thereof. Different materials will be suitable depending on the desired characteristics and intended uses of training apparatus 10. For example, if training apparatus 10 primarily will be used with children or if weight and portability are important, PVC or aluminum pipe or plastic materials may be preferable materials. The same or similar materials may be preferable if training apparatus 10 will primarily be used outdoors. In other circumstances, such as where training apparatus 10 will be used by older shooters or in other conditions, different materials may be more or less desirable.

Figure 5:
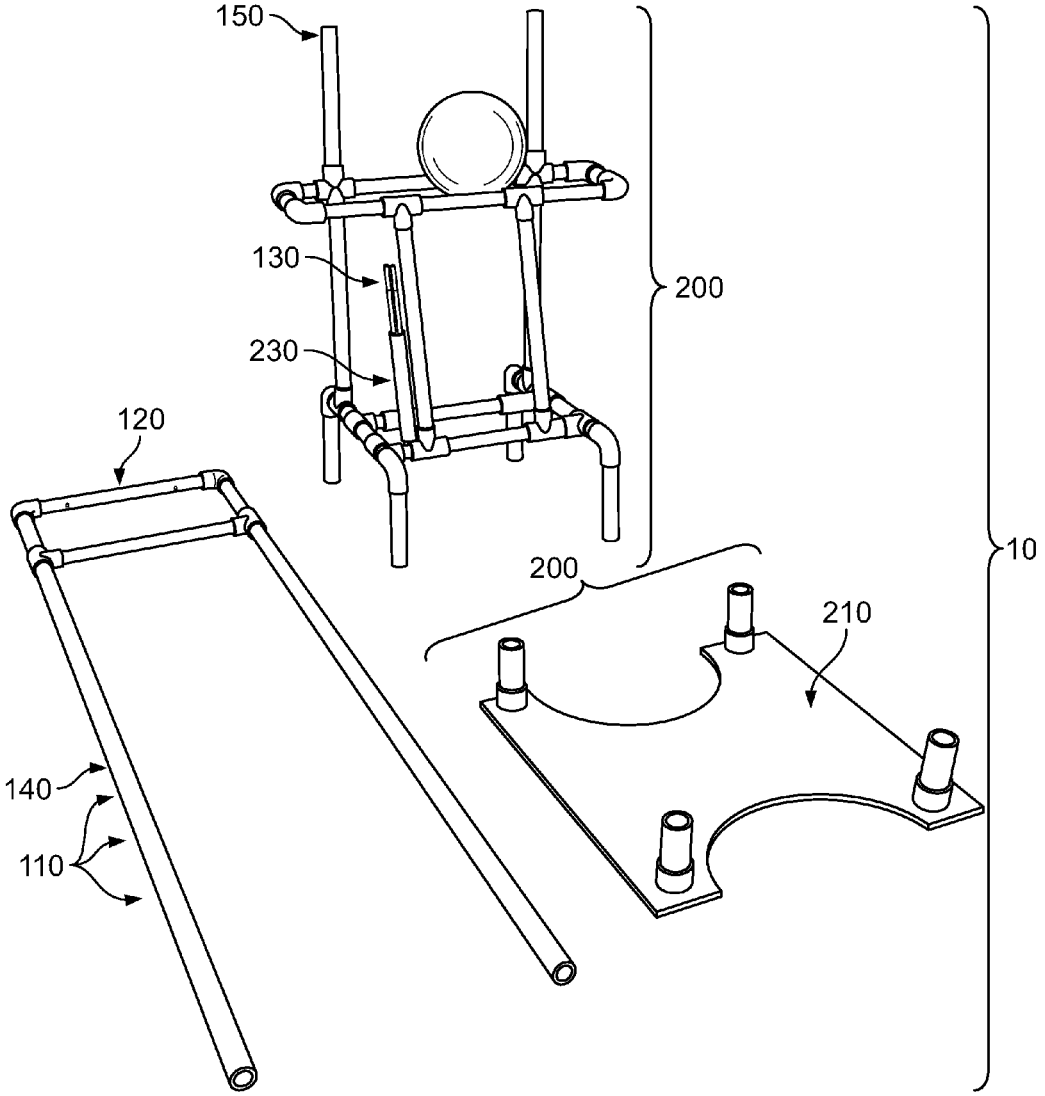
FIG. 5 is a view of a partially disassembled adjustable basketball training apparatus.

As shown in FIG. 5, training apparatus 10 may be configured to be disassembled for both enhanced portability and storage efficiency. Disassembly may be accomplished in a number of different ways. In one embodiment, the training apparatus 10 may be disassembled by removing upper portion 100 from lower portion 200. In another embodiment, other parts of training apparatus 10 may be configured for removal or disassembly, including horizontal obstruction 120, vertical obstruction 130, sliding frame 140, receiving member 150, ball storage rack 220, storage compartment 230, and base 210, either in addition to or in place of removing upper portion 100 from lower portion 200. FIG. 5 shows one example of how training apparatus 10 may be configured for disassembly, with retainer 160 removed, sliding frame 140 of support member 110 and horizontal obstruction 120 disassembled from receiving member 150 of support member 110, vertical obstruction 130 stored in compartment 230, and base 210 removed from the lower portion 200. The training apparatus also may be equipped with couplings of different types to facilitate easy assembly and disassembly. In another embodiment, the training apparatus may be configured such that upper portion 100 can be removed and stored at least partially within lower portion 200. By providing for disassembly, training apparatus 10 may be stored in an area that could not otherwise accommodate the fully-assembled apparatus or transported in a more convenient way.

When used as a shooting tool, training apparatus 10 can help the shooter eliminate flat shots. For example, in free throw situations, training apparatus 10 can be positioned and configured so that horizontal obstruction 120 and vertical obstruction 130 will impede a shot unless the shooter uses proper alignment, arc and follow through as shown in FIG. 2. The ability to adjust the configurations of horizontal obstruction 120 and vertical obstruction 130 likewise facilitates use of training apparatus 10 for practicing jump shooting from varying locations on the court by shooters of varying size and ability.

Training apparatus 10 also can be used for practicing in the open court. When used in this manner, the shooter must maintain proper control of his or her dribble when working around the apparatus and approaching the basket. The dimensions of the apparatus also may provide a barrier for a player to practice passing pass over or around. For example, when practicing a skip pass, the player must account for proper arc in launching over training apparatus 10. Training apparatus 10 also can simulate a defender when the player is driving to the basket and trying to feed an approaching teammate.

As shown in FIGS. 6*a* and 6*b*, training apparatus 10 also can be positioned under the basket and adjusted using support members 110 to simulate a post defender. In such use, player 600 can work with his or her back to the basket (and training apparatus 10) and practice shooting over the apparatus as a simulated leaping defender. FIG. 6*a* shows player 600 positioned with his back to basket 300, prepared to receive passed ball 610. In FIG. 6*b*, player 600 has received the pass, turned to face up training apparatus 10, and released a shot so that it clears horizontal member 120. Thus, training apparatus 10 can help a shooter by forcing him or her to use a proper arc and angle when shooting off the backboard. Use of one or more vertical obstructions 130 also may enhance the effectiveness of training apparatus 10 by, for example, simulating a vertical defender or a defender with outreached arms. The shooter thus can use training apparatus 10 to practice offensive positioning and low post moves to the basket against a simulated defender whose reach is similar to that of a jumping defender.

Although the embodiments of the invention described herein have been illustrated in the accompanying drawings and described in the foregoing detailed description, it is to be understood that such invention is not to be limited to just the embodiments disclosed, but that the invention described herein is capable of numerous rearrangements, modifications, substitutions and uses without departing from the scope of the claims hereafter. The claims as follows are intended to include all modifications, alterations and uses insofar as they come within the scope of the claims or the equivalent thereof.

I claim:

1. An adjustable basketball training apparatus comprising:

a lower portion including:

a support base;

a pair of lower tubular receiving members secured on said support base, wherein said pair of lower receiving members include a height for accommodating a basketball storage rack;

a basketball storage rack having a back side, a front side a pair of sides forming an opening therebetween, wherein said backside is attached to said pair of lower receiving members and said front side includes support members for securely attaching said front side on said support base;

wherein said basketball storage rack is configured to face a shooter in order to permit easy access to stored basketballs for use in repetitive shooting drills, and wherein a height of said basketball storage rack is adjustable to accommodate different height shooters;

an upper portion including:

an adjustable U-shaped frame having first and second vertical members and an upper horizontal member formed therebetween, wherein said U-shaped frame is slidably received and secured within said pair of lower receiving members;

an adjustable horizontal obstruction slidably supported on said first and second vertical members, said horizontal obstruction positioned below said upper horizontal member; and a pair of adjustable vertical obstructions removably attached to said horizontal obstruction, wherein said pair of vertical obstructions aid a basketball shooter to release a basketball with a desirable trajectory relative to said pair of vertical obstructions.

2. The adjustable basketball training apparatus of claim 1, wherein the intended target is a basketball backboard and rim.

3. The adjustable basketball training apparatus of claim 1, wherein the intended target is another basketball player.

4. A method for training a basketball shooter to release a basketball with a desirable trajectory, the method comprising the steps of:

providing an adjustable basketball training apparatus, said training apparatus comprising a lower portion and an upper portion, said lower portion including:

a support base, positioning said support base on a support surface;

securing a pair of lower receiving members on said support base;

a basketball storage rack having a back side, a front side a pair of sides forming an opening therebetween, securing said backside of said basketball storage rack said front side includes support members for securely attaching said front side on said support base;

adjusting a height of said basketball storage rack on said pair of lower receiving members to accommodate different height shooters, adjusting an angle of said basketball storage rack such that stored basketballs roll to one or other side as stored basketballs are removed from said basketball storage rack;

said upper portion including:

an adjustable U-shaped frame having first and second vertical members and an upper horizontal member formed therebetween, slidably securing said U-shaped frame within said pair of lower receiving members;

slidably attaching an adjustable horizontal obstruction on said first and second vertical members, wherein said horizontal obstruction is positioned below said upper horizontal member;

removably positioning a pair of adjustable vertical obstructions on said horizontal obstruction;

configuring said basketball training apparatus such that said basketball storage rack is facing a basketball shooter in order to permit easy access to stored basketballs during repetitive shooting drills;

positioning said basketball training apparatus between said basketball shooter and an intended target; and adjusting said sliding frame to aid a basketball shooter to release a basketball with a desirable trajectory toward the intended target;

said basketball shooter releasing a basketball with a desirable trajectory relative to said pair of vertical obstructions toward the intended target such that the basketball avoids the pair of vertical obstructions.

5. The method of claim 4, wherein the intended target is a basketball backboard and rim, and wherein the step of shooting a basketball toward the target includes shooting a basketball toward said basketball backboard and rim.

6. The method of claim 4 wherein the intended target is another person, and wherein the step of shooting a basketball toward the target includes shooting a basketball toward said another player.

* * * * *